US005520626A

United States Patent [19]

Schaeffer

[11] Patent Number: 5,520,626

[45] Date of Patent: May 28, 1996

[54] COMBINATION PALM AND FINGER GUARD

[76] Inventor: Michael A. Schaeffer, 4603 SW. 67th Ter., Gainesville, Fla. 32608

[21] Appl. No.: 370,859

[22] Filed: Jan. 10, 1995

[51] Int. Cl.[6] ..... A61F 5/04

[52] U.S. Cl. ..... 602/22; 2/21

[58] Field of Search ..... 602/22, 5; 2/21; 128/880

[56] References Cited

U.S. PATENT DOCUMENTS

| | | | |
|---|---|---|---|
| 2,250,766 | 7/1941 | Jorgenson | 2/21 |
| 4,674,487 | 6/1987 | Schaeffer | 602/22 |
| 4,704,742 | 11/1987 | Foster | 2/21 |
| 4,899,916 | 2/1990 | Townsend | 2/21 X |
| 4,984,592 | 1/1991 | Hellein | 2/21 X |
| 5,363,508 | 11/1994 | Kim | 2/21 |

*Primary Examiner*—Linda C. Dvorak
*Attorney, Agent, or Firm*—Arthur G. Yeager

[57] ABSTRACT

A disk-shaped plastic shield adapted to rest against the palm of the hand of the hair cutter adjacent to a knuckle to prevent scissor cuts when trimming hair, and a finger guard.

10 Claims, 1 Drawing Sheet

COMBINATION PALM AND FINGER GUARD

TECHNICAL FIELD OF THE INVENTION

This invention relates to the technical field of hair cutting equipment and instruments.

BACKGROUND OF THE INVENTION

Barbers, hair stylists, and the like frequently cut the skin of their hands and fingers with sharp scissors while trimming and/or styling hair. The prior art has provided substantially nothing to prevent such cuts until my patent, U.S. Pat. No. 4,674,487, issued in 1987, disclosing a spiral band, which wraps around a barber's middle finger to ward off the scissor blades when trimming hair held between the index and middle fingers. Even this guard allows the cutter's palm to be at risk. This type of trim occurs when the palm of the hand faces the head of the one whose hair is being trimmed. There is, however, risk of another type when trimming hair held between the same two fingers, when the palm is facing the one who is cutting the hair. This involves the tips of the blades cutting the skin of the cutter's palm where the skin is located, or the knuckle area. It is to this problem that the invention is directed.

It is an object of this invention to provide a guard or shield to protect from cutting one's own skin on both the palm and fingers of the hand while cutting hair. It is another object of this invention to provide a plastic shield to be worn on the barber's non-cutting hand to protect against scissor cuts when doing certain hair trimming operations. Still other objects will become apparent from the more detailed descriptions which follow.

BRIEF SUMMARY OF THE INVENTION

This invention relates to a guard or shield to be worn on the non-cutting hand of the hair cutter to protect against the scissors cutting the palm or fingers. The shield comprised of a small disk of hard material adapted to rest against the hair cutter's palm adjacent to a knuckle, and a means for attaching the disk to a finger adjacent to that knuckle. In specific embodiments, the means for attaching may be a knuckle or finger guard for hair cutters and a finger ring, or other equivalent attachments.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best understood by reference to the attached drawings.

Figure 1:
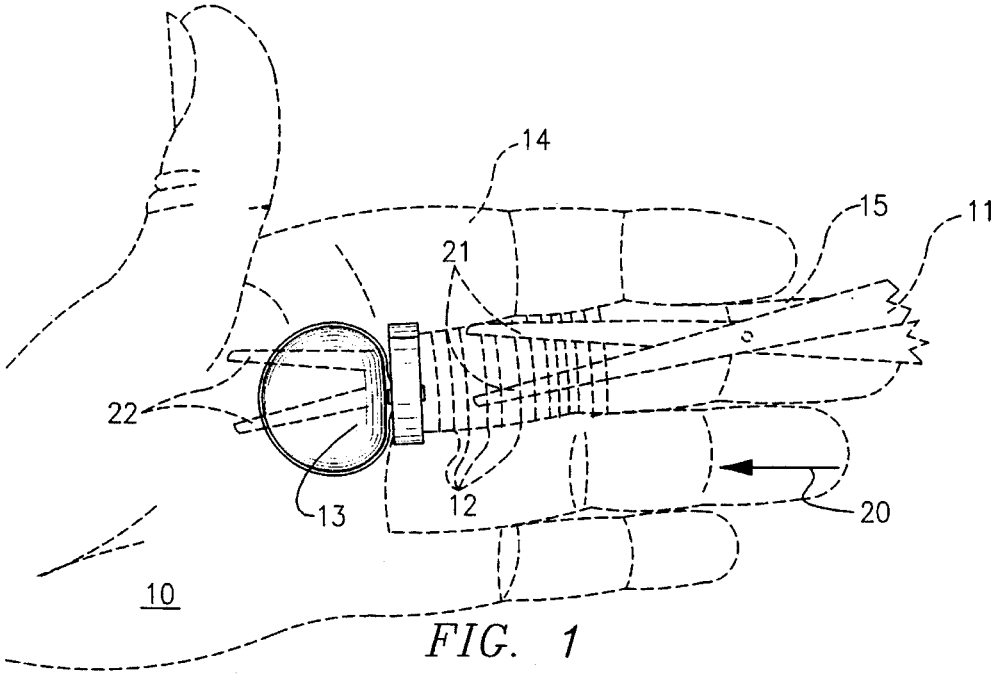
FIG. 1 is a schematic front elevation view of a hand showing how the invention is used by a hair cutter.

The manner in which the invention is used is shown in FIG. 1. It is assumed that the user is a barber or hair stylist, or anyone who cuts hair, whose left hand 10 smooths, combs, and handles the hair of a client, and whose right hand operates scissors 11 in cutting the hair, or visa versa. Among other manipulations of the barber is the one pictured in FIG. 1. Here, a few strands of hair 12 are held between the index finger 14 and the middle finger 15 while the palm of the hand 10 faces the barber. In this position the barber trims off the hair 12 by operating the scissors while moving the scissors from right to left in the direction of arrow 20 until all of hair strands 12 have been cut. At the full extent of movement to the left of the scissors 11, the scissor 21 will be overlaying part of the palm of hand 10, perhaps in the position 22 (shown in dashed lines). It is very easy for sharp scissors in the position 22 to pinch and cut the skin of the palm. Accordingly, the present invention provides a shield or guard 13 to lie close to the skin of the palm so as to divert the tips 21 of scissors 11 away from the skin. In this way the barber can cut hair 12 as fast as he or she wishes without fear of cutting the skin of the palm of hand 10.

Figure 2:
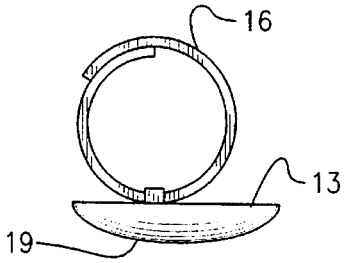
FIG. 2 is a top plan view of the shield of this invention attached to a finger ring.
Figure 3:
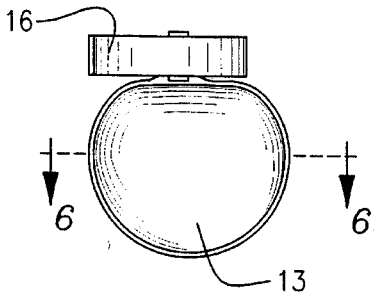
FIG. 3 is a front elevation view of the shield and ring of FIG. 2.
Figure 6:
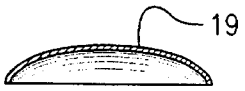
FIG. 6 is a cross-section view of the shield of FIG. 3 taken at 6—6.

The shield or guard 13 may be held in place in any fashion that is feasible. A preferred embodiment is shown in FIGS. 2–3, and 6 where a simple finger ring 16 is employed. Preferably, finger ring 16 can be an integral part of shield 13 and is expandable to fit different sizes of fingers. If shield 13 is made of silver, ring 16 would also be silver. It is, of course, entirely appropriate to employ any finger ring and to slip shield under ring 13 thereto. Preferably, shield 13 is a domed structure, which might result from cutting off a slice from a sphere as indicated in FIG. 6 where 19 is the high point or apex of the domed structure. Other shapes, such as pyramidal, may be used but a curved convex surface as at 19 is preferred. The shield 13 may be solid or a hollow shell as shown at FIG. 6. Any hard surfaced material can be used. Plastic is probably the most convenient material for shield 13 although metal, stone or hard wood are usable.

The shield of FIGS. 2–3 and 6 is probably most easily worn on any finger 15 the knuckle guard fits although it might be worn on index finger 14. The only difference in wearing it on one finger or another is that the connection between shield 13 and ring 16, if ring is used, must be sufficiently flexible to permit twisting so as to position shield 13 over the precise area of the palm to be protected.

Figure 4:
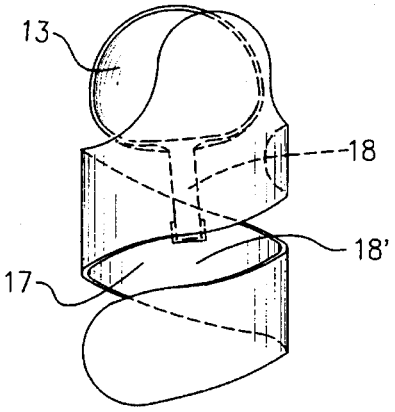
FIG. 4 is a top plan view of a knuckle guard of U.S. Pat. No. 4,676,487 with a shield of this invention attached thereto.
Figure 5:
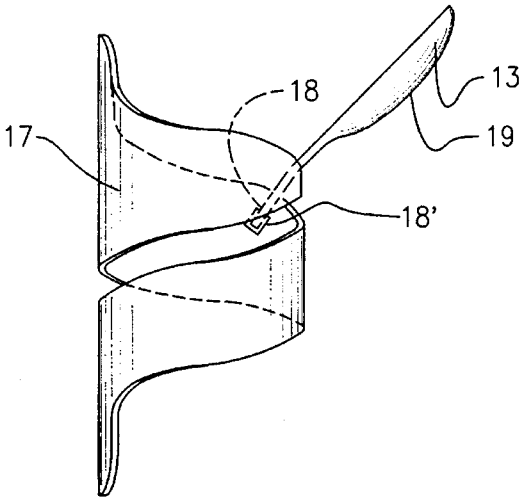
FIG. 5 is a side elevation view of the knuckle guard and shield of FIG. 4.

In FIGS. 4 and 5 there is illustrated the embodiment of combining the shield 13 of this invention with a knuckle guard 17 of my U.S. Pat. No. 4,674,487, which issued Jan. 23, 1987. The patented knuckle guard is a helical strip which is positioned around the middle finger 15 of the hand 10, which does not manipulate the scissors 11. This knuckle guard is employed to prevent scissor cuts around the second knuckle of middle finger 15. It can also serve to support the shield 13 of this invention by merely adding a short connecting strip 18 to join the two. Strip 18 must be flexible so as to permit it to be bent and/or twisted to position it over the palm area to be protected. This is entirely feasible as shown in FIGS. 4–5. Snapping of strip 18 of shield 13 into a socket 18' of knuckle guard 17 is the preferred connection when all components are of the same material.

The shield 13 may be made in various sizes and shapes so as to cover the endangered area of the palm. Generally, round shapes are preferred of about 0.5–1.0 inch in diameter, although square, triangular, or odd shapes are operable and sizes may vary to suit all sizes of hands.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to be secured by Letters Patent of the United States is:

1. A combination palm and finger guard for use by a user cutting hair with scissors in one hand, said guard comprising a middle finger guard and a small shield, means for attaching said shield to said middle finger guard adapted to be worn on a user's other hand which grips hair between the index finger and the middle finger, said shield cooperable with said middle finger guard and adapted to be located to cover an area of a palm adjacent to a first knuckle of a middle finger, said middle finger guard having a passage adapted to receive therethrough a middle finger of a user's other hand, said shield extending generally along and unobtrusive to said passageway.

2. The palm guard of claim 1 wherein said middle finger guard is elongated for covering a substantial length of a middle finger.

3. The palm guard of claim 1 wherein said shield includes a guard ring for a middle finger.

4. The palm guard of claim 1 wherein said shield is a portion of a substantially spherical surface, said portion being approximately 0.5–1.0 inch in overall diameter.

5. A palm guard for use by a user cutting hair with scissors, said guard comprising a small disk of material unable to be cut by hair cutting scissors, said disk being positionable over an area of a knuckle on a palm side of a hand of a user, and means for supporting and maintaining said disk from a location adjacent a base of a finger adjacent to a knuckle said means for supporting including a passageway adapted to receive a finger of a user, said disk extending generally along said passageway to permit locating said disk over an area of a knuckle on a palm side of a hand of a user.

6. The palm guard of claim 5 wherein said means for supporting includes a finger ring.

7. The palm guard of claim 5 wherein said disk is dome-shaped with its convex portion of said dome being adapted to face away from a palm of a hand of a user.

8. The palm guard of claim 5 further comprising a finger knuckle guard integral with said palm guard and adapted to extend a predetermined length along a finger of a wearer.

9. The palm guard of claim 8 wherein said palm guard and knuckle guard are formed of plastic.

10. A palm guard for use by a user cutting hair with scissors, said guard comprising a small disk of material unable to be cut by hair cutting scissors, said disk being positionable over an area of a knuckle on a palm side of a hand of a user, and means for supporting and maintaining said disk from a location adjacent a base of a finger adjacent to a knuckle, a finger knuckle guard integral with said palm guard and adapted to extend a predetermined length along a finger of a wearer, said knuckle guard including a portion adapted to protect a first knuckle on a back of a hand of a middle finger and another portion adapted to protect a second knuckle on a back of a hand of a middle finger.

* * * * *